US008807248B2

(12) United States Patent
Bise et al.

(10) Patent No.: US 8,807,248 B2
(45) Date of Patent: Aug. 19, 2014

(54) CUTTING INSERT FOR A ROOF DRILL BIT

(75) Inventors: Douglas Edward Bise, Chilhowie, VA (US); Seth Daniel Colvin, Bedford, PA (US); Chad Allen Swope, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 625 days.

(21) Appl. No.: 13/069,495

(22) Filed: Mar. 23, 2011

(65) Prior Publication Data

US 2012/0241223 A1 Sep. 27, 2012

(51) Int. Cl.
*E21B 10/36* (2006.01)
*E21B 10/58* (2006.01)
*E21B 10/38* (2006.01)

(52) U.S. Cl.
CPC ..... *E21B 10/58* (2013.01); *E21B 10/38* (2013.01)
USPC ..... 175/427; 175/420.1; 175/426; 175/430; 175/431

(58) Field of Classification Search
CPC ..... E21B 10/62; E21B 2010/62; E21B 10/58; B23B 51/00; B23B 2251/50; B23B 2226/75
USPC ..... 175/427, 420.1, 426, 430, 431, 415, 175/428
See application file for complete search history.

(56) References Cited

U.S. PATENT DOCUMENTS

| | | | | |
|---|---|---|---|---|
| 5,311,959 | A | 5/1994 | Adams | |
| 6,446,741 | B1 * | 9/2002 | Kersten et al. | 175/428 |
| 6,684,968 | B2 * | 2/2004 | Bise et al. | 175/427 |
| 2010/0187019 | A1 | 7/2010 | Swope et al. | |

* cited by examiner

*Primary Examiner* — Jennifer H Gay
*Assistant Examiner* — George Gray
(74) *Attorney, Agent, or Firm* — Matthew W. Smith, Esq.

(57) ABSTRACT

A hard cutting insert for use with a roof drill bit includes a first webbed notch and a second webbed notch structured and arranged on the hard insert for removing or evacuating drilling debris from an upper surface of the hard insert during a drilling operation. A roof drill bit including a hard cutting insert having a first webbed notch and a second webbed notch structured and arranged on the hard insert.

11 Claims, 5 Drawing Sheets

CUTTING INSERT FOR A ROOF DRILL BIT

BACKGROUND OF THE INVENTION

The invention relates to a hard cutting insert for use in a roof drill bit that has a typical use of drilling boreholes in mine roofs. More particularly, the invention pertains to a hard cutting insert for use in a roof drill bit that exhibits an improvement in the performance of drilling boreholes in a roof bolting operation due to an improvement in drilling debris evacuation.

Expansion of an underground mine such as, for example, a coal mine, requires digging a tunnel. Initially this tunnel has an unsupported roof. In order to support and stabilize the roof in an established area in an underground tunnel, bore holes are drilled in the roof. The apparatus used to drill these holes comprises a drill with a long shaft, i.e., drill steel, attached to a drill bit. U.S. Pat. No. 6,533,049 to Rein, Sr., et al. and U.S. Pat. No. 6,598,688 to Wang each show a drill steel that is useful in a roof drill bit assembly for drilling such bore holes. U.S. Pat. No. 3,554,306 to Wilburn shows a drill rod assembly that is useful for drilling roof bolt bore holes.

A roof drill bit is detachably mounted, either directly or through the use of a chuck, to the drill steel at the distal end thereof. U.S. Pat. No. 5,927,411 to Sheirer and U.S. Pat. No. 5,833,017 to Woods et al. each show a roof drill bit assembly. To commence the drilling operation, the roof drill bit is then pressed against the roof and the drilling apparatus is operated so as to drill a bore hole in the roof. The bore holes may extend between two feet to greater than twenty feet into the roof. These bore holes are filled with resin and roof bolts are affixed within the bore holes. A roof support, such as roof panels, is then attached to the roof bolts.

As one can appreciate, the drilling operation generates drilling debris. It is important to remove this drilling debris from the vicinity of the borehole. More particularly, it is important to remove the drilling debris from the vicinity of where the hard cutting insert initially engages the earth strata so as to decrease wear on the hard cutting insert and increase the overall efficiency of the drilling operation.

Thus, it would be highly desirable to provide an improved hard cutting insert that better evacuates drilling debris during a drilling operation.

SUMMARY OF THE INVENTION

In accordance with an aspect of the invention, a hard insert for use with a roof drill bit includes a first side and a second side opposing and generally parallel to the first side wherein the first and second sides extend in a longitudinal dimension of the hard insert. The hard insert also includes a first inclined upper surface and a second inclined upper surface that are both positioned between the first and second sides. The hard insert further includes a first webbed notch and a second webbed notch structured and arranged on the upper surface of the hard insert for removing or evacuating drilling debris from the upper surface of the hard insert during a drilling operation.

In accordance with another aspect of the invention, a hard insert for use with a roof drill bit includes a first side and a second side opposing and generally parallel to the first side, wherein the first and second sides extend in a longitudinal dimension of the hard insert. The hard insert also includes a first inclined upper surface and a second inclined upper surface that are both positioned between the first and second sides. The hard insert also includes means for removing or evacuating drilling debris from the upper surface of the hard insert during a drilling operation.

In accordance with an additional aspect of the invention, a roof drill bit includes an elongate roof drill bit body having a forward end and a rearward end wherein the roof drill bit body contains a slot at the forward end. The roof drill bit also includes a hard insert received within the slot of the drill bit body, wherein the hard insert includes a first webbed notch and second webbed notch structured and arranged on an upper surface of the hard insert for removing or evacuating drilling debris from the upper surface of the hard insert during a drilling operation.

These and other aspects of the present invention will be more fully understood following a review of this specification and drawings.

DETAILED DESCRIPTION

Figure 1:
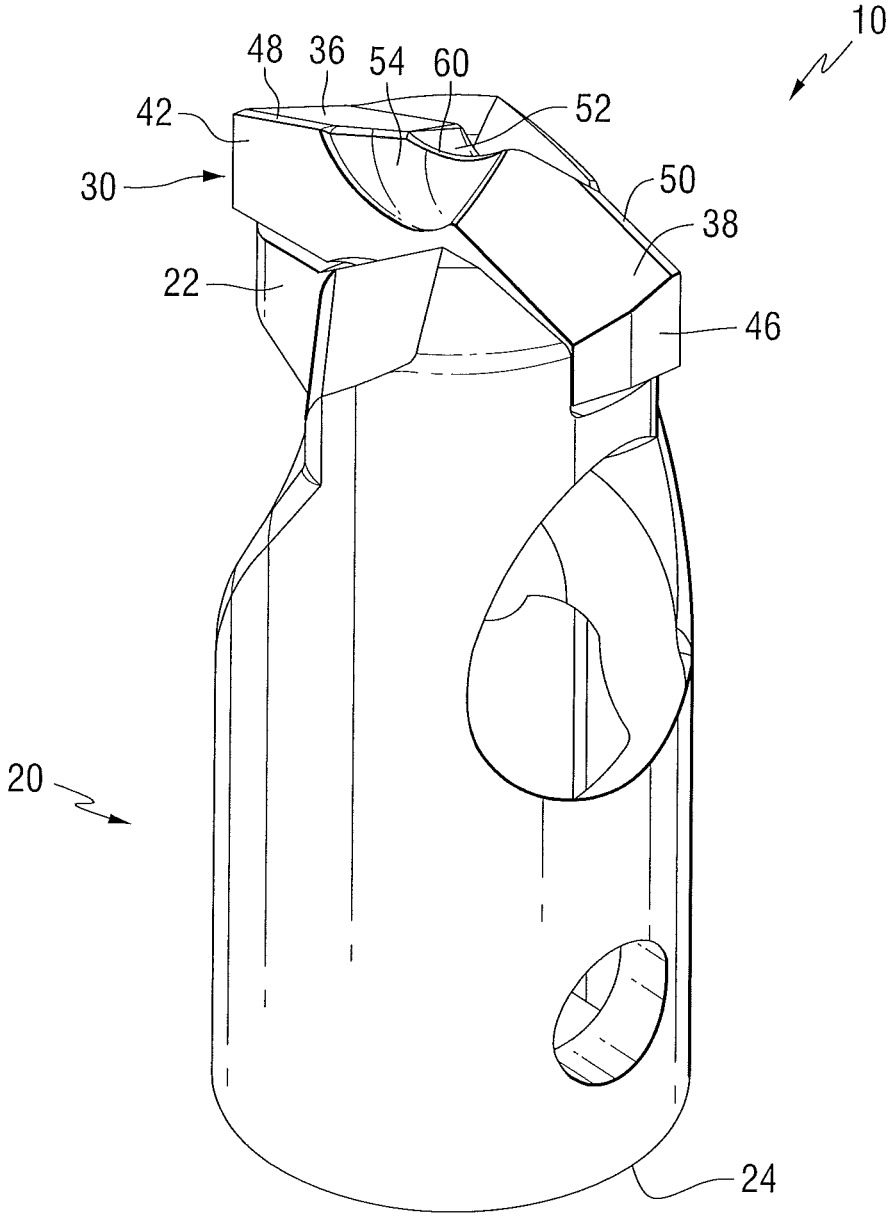
FIG. 1 is an isometric view of a roof drill bit assembly, in accordance with an aspect of the invention.
Figure 2:
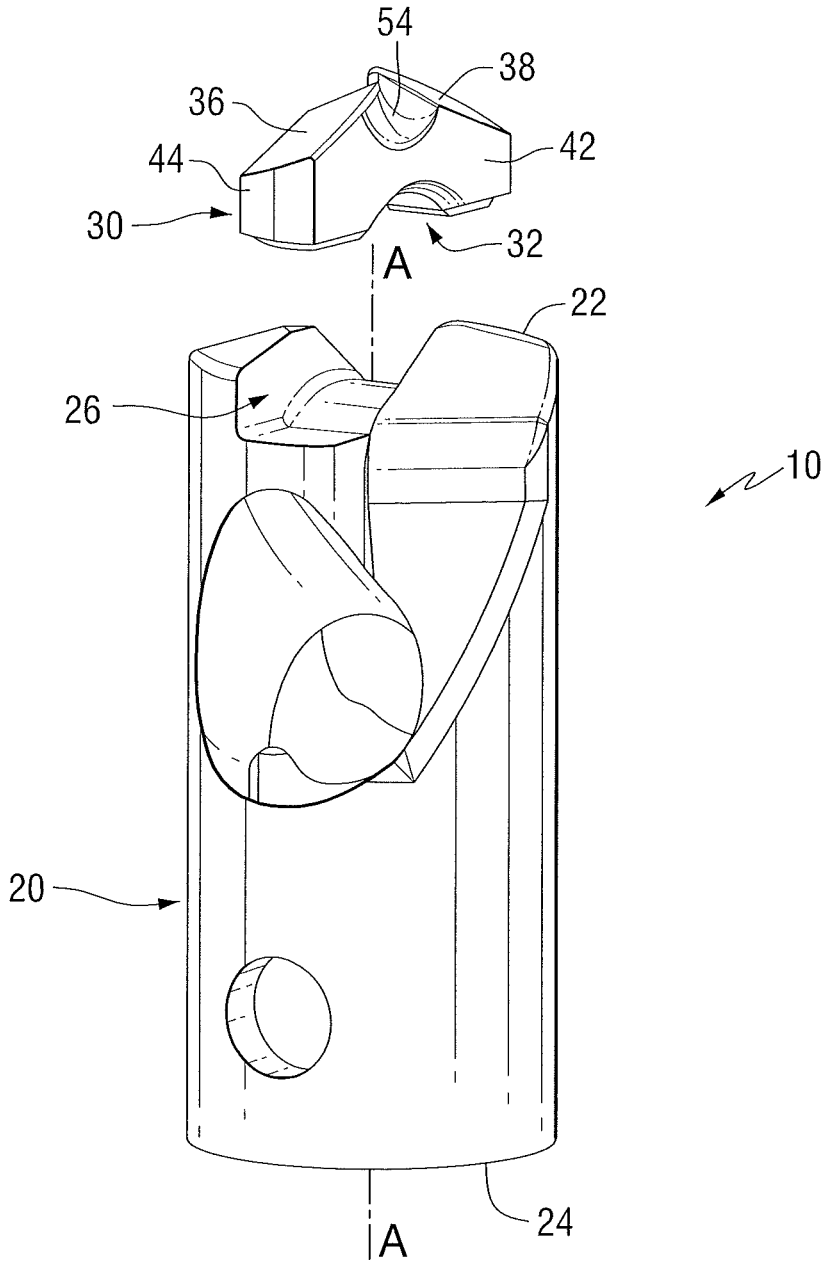
FIG. 2 is an isometric view of the roof drill bit assembly of FIG. 1 with the hard insert exploded away from the roof drill bit body, in accordance with an aspect of the invention.
Figure 3:
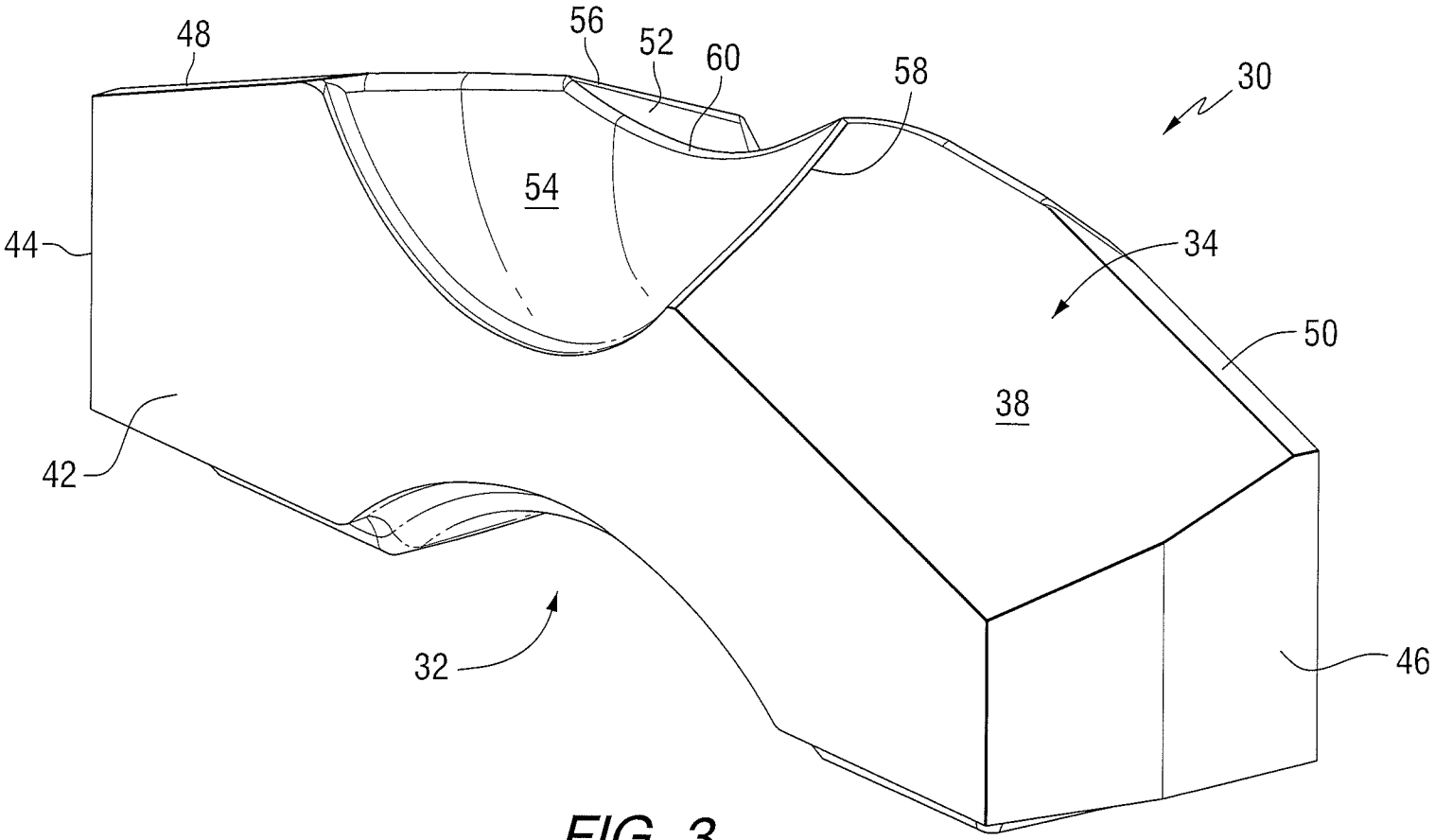
FIG. 3 is an isometric view of the hard insert of FIGS. 1 and 2, in accordance with an aspect of the invention.
Figure 4:
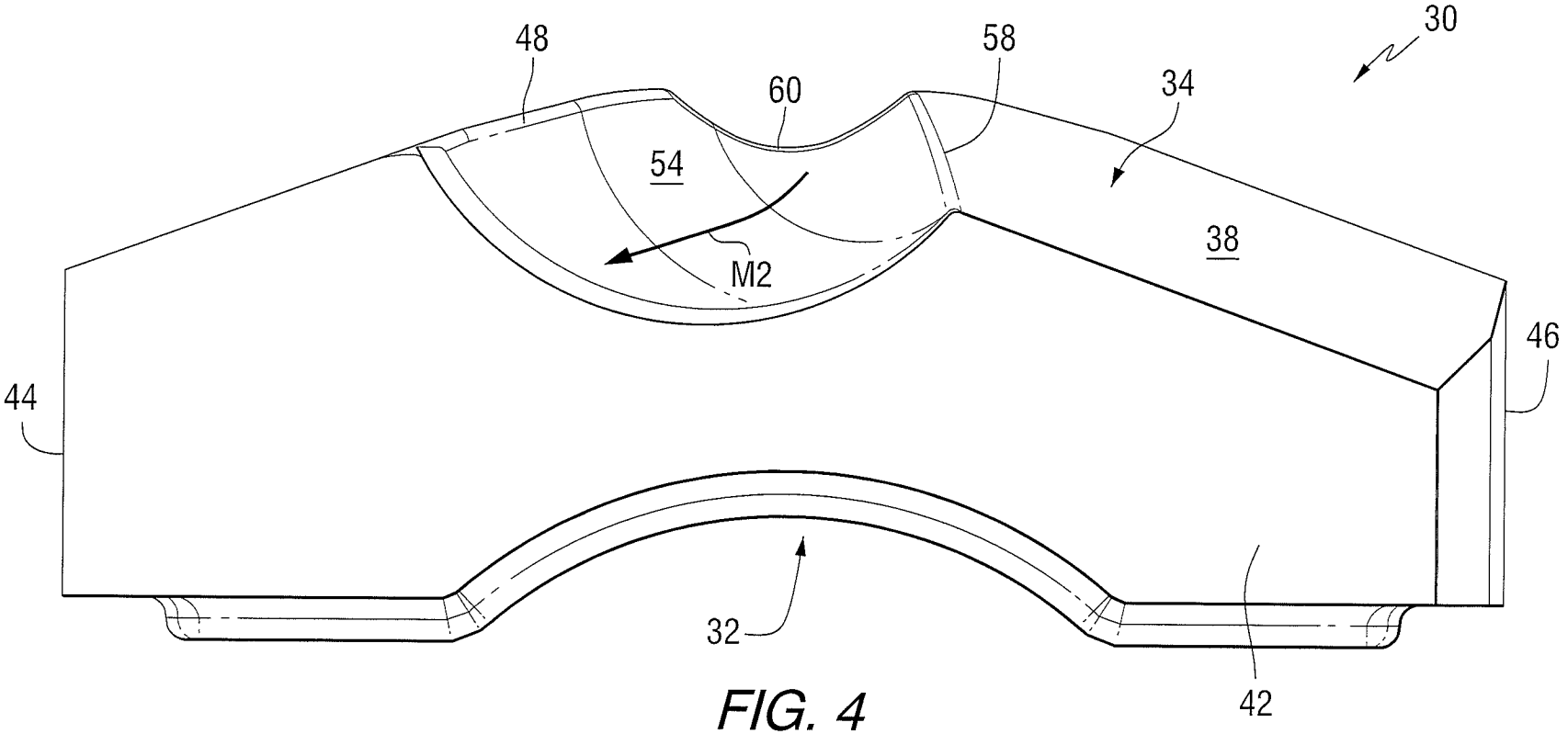
FIG. 4 is a side elevational view of the hard insert of FIG. 3, in accordance with an aspect of the invention.
Figure 5:
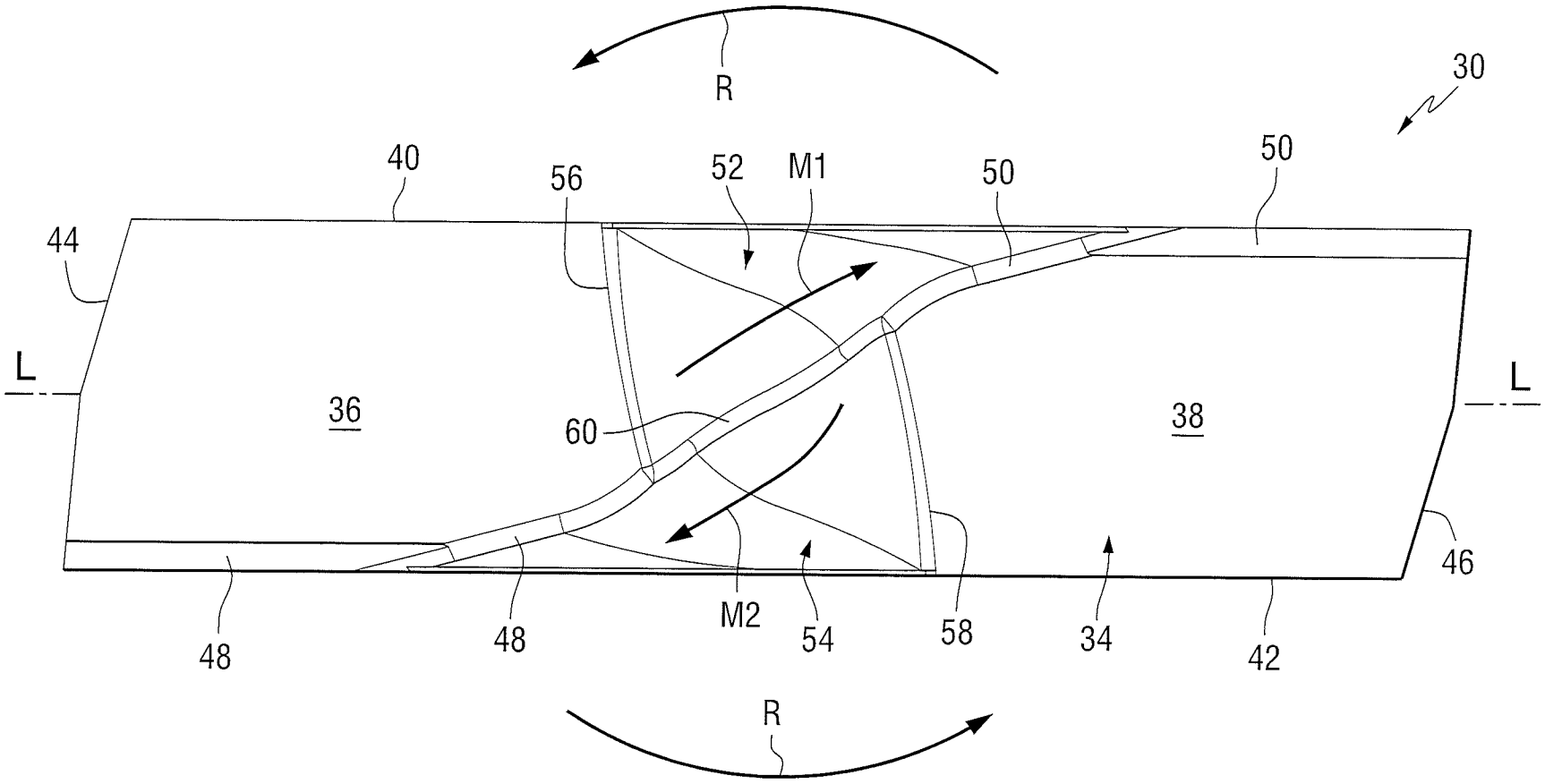
FIG. 5 is a top plan view of the hard insert of FIGS. 3 and 4, in accordance with an aspect of the invention.

Referring to FIGS. 1 and 2 there is shown a roof drill bit assembly generally designated as 10, in accordance with an aspect of the invention. The assembly 10 includes a roof drill bit body 20 and a hard cutting insert 30. Roof drill bit body 20 has an axial forward end 22 and an axial rearward end 24. Roof drill bit body 20 has a central longitudinal body axis A-A. The preferred method to make the roof drill bit body 20 is cold-forming. Using cold-forming techniques to make the roof drill bit body 20 results in a number of advantages that improve the overall performance of the roof drill bit itself. U.S. Pat. No. 6,915,867 B2 to Bise (assigned to Kennametal Inc. of Latrobe, Pa.), the contents of which are fully incorporated herein by reference, discloses a roof drill bit body made via cold-forming techniques.

Although the preferred manufacturing technique is cold-forming, there should be an appreciation that powder metallurgical techniques are also suitable to make the roof drill bit body 20. Powder metallurgical techniques provide the opportunity to employ a wide variety of materials for the manufacture of the roof drill bit body 20. This is in contrast to manufacturing processes that require machining or extensive machining.

Roof drill bit body 20 contains a diametrical slot 26 in the axial forward end 22 thereof. The hard cutting insert 30 is received in the slot 26 such that an arched or arcuate surface 28 of the roof drill bit body 20 is received in an arched or arcuate surface 32 formed in the bottom surface of the hard insert 30. Brazing is a typical method useful to attach or affix the hard insert 30 to the roof drill bit body 20 within the slot 28. Hence, there is a braze joint between the bottom surface of the hard cutting insert 30 and the surfaces that define the slot 28. Typical braze alloys useful in this kind of application include high temperature braze alloys. More specifically, these kinds of braze include the following: Handy HI TEMP 548 braze alloy, manufactured and sold by Handy & Harmon, Inc., 859 Third Avenue, New York, N.Y. 10022. HANDY HI-TEMP 548 braze alloy has a nominal composition (in weight percent) of 54.0-56.0% copper; 5.5-6.5% nickel; 3.5-4.5% manganese; 0.01-0.40% silicon; the balance is zinc except for a maximum content of other elements equal to 0.50 weight percent. There should be an appreciation that there is no intention to limit the scope of the invention by the recitation of a specific braze alloy.

In one aspect of the invention, the roof drill bit body 20 may be as described, for example, in United States Patent Publication No. 2010/0187019 A1 to Swope et al. (assigned to Kennametal Inc. of Latrobe, Pa.), the contents of which are fully incorporated herein by reference. However, it will be appreciated that there is no intention to limit the scope of the invention by the description, illustration or incorporation by reference set forth herein of the types of roof drill bit bodies that may be used within the scope of the invention.

Referring to FIGS. 1-5, the hard cutting insert 30 will be described in more detail. Hard cutting insert 30 typically comprises a hard material such as, for example, cemented (cobalt) tungsten carbide. Conventional cemented (cobalt) tungsten carbide materials useful for a hard cutting insert 30 include a composition of cobalt-tungsten carbide wherein the cobalt ranges between about 2 weight percent and about 12 weight percent with the balance tungsten carbide and recognized impurities. More specifically, a preferred composition for the hard insert 30 comprises about 6 weight percent cobalt and the balance tungsten carbide and recognized impurities. There should be an appreciation that there is no intention to limit the scope of the invention by the recitation of specific cemented carbide compositions or ranges for the cemented carbide compositions.

Hard insert 30 has a top upper (or axial forward) surface 34, which presents two inclined surfaces, specifically a first inclined upper surface 36 and a second inclined upper surface 38. Hard cutting insert 30 further has a pair of side surfaces 40, 42 and a pair of opposite edge or end surfaces 44, 46. In one aspect, the sides 40, 42 are generally flat and extend generally parallel to one another and generally parallel to a longitudinal axis L-L of the insert 30.

The hard insert 30 also includes cutting surfaces, specifically a first cutting surface 48 and a second cutting surface 50. In one aspect, the cutting surface 48 extends to the end 44 and is adjacent the first inclined upper surface 36. Similarly, the cutting surface 50 extends to the end 46 and is adjacent the second inclined upper surface 38. These cutting surfaces include cutting edges that engage the earth strata so that upon rotation of the roof drill bit assembly 10, they cut (drill) a borehole. Such drilling generates drilling debris (including dust and larger particles and pieces of the earth strata).

In another aspect of the invention, the hard insert 30 includes a first webbed notch 52 and a second webbed notch 54. The webbed notches 52, 54 are structured and arranged on the upper surface 34 of the hard insert 30 for assisting in the removal or evacuation of drilling debris from the upper surface 34 of the hard insert 30 during a drilling operation.

In one aspect of the invention, the first webbed notch 52 and the second webbed notch 54 are positioned at a generally central portion of the upper surface 34 of the hard insert 30. The first webbed notch 52 is generally adjacent the second webbed notch 54. For example, the first webbed notch 52 is adjacent the side 40 and extends generally between an inner end 56 of the first inclined upper surface 36 and the second cutting surface 50 of the second inclined upper surface 38. Similarly, the second webbed notch 54 is adjacent the side 42 and extends generally between a first inner end 58 of the second inclined upper surface 38 and the cutting surface 48 of the first inclined upper surface 36.

The first webbed notched 52 and the second webbed notch 54 may have various shapes and configurations for most efficiently assisting in the removal of drilling debris from the upper surface 34 of the hard insert 30 during a drilling operation. In one aspect, the first webbed notch 52 and the second webbed notch 54 have a generally concave shape or configuration. Advantageously, when the hard insert 30 is rotated during a drilling operation in the direction as indicated by arrow R (see FIG. 5), the shape and configuration of the first webbed notch 52 provides for drilling debris to be removed or evacuated away from the upper surface 34 of the hard insert as the drilling debris generally moves in the direction as indicated by arrow M1. Similarly, rotation of the hard insert 30 in the direction of arrow R provides for the second webbed notch 54 to remove or evacuate the drilling debris away from the upper surface 34 such that the debris moves generally in the direction of arrow M2.

In another aspect of the invention, a central cutting surface 60 extends between the first webbed notch 52 and the second webbed notch 54. The central cutting surface 60 may have various shapes and configurations. In one aspect of the invention, the central cutting surface is generally concave (see, for example, FIGS. 3 and 4). Advantageously, the generally concave shape of the central cutting surface 60 prevents the buildup of drilling debris material at the central portion of the hard insert 30 and contributes to the efficient removal or evacuation of the drilling debris away from the upper surface 34 of the hard insert 30 as the drilling debris in the area of the central cutting surface 60 is received within the first and second webbed notches 52, 54 and evacuated from the upper surface 34, as described herein.

In another aspect, the central cutting surface 60 extends between the first end cutting surface 48 and the second end cutting surface 50. This provides a continuous cutting surface that extends from the end 44 of the hard insert to the opposing end 46 of the hard insert 30 so as to provide for more efficient drilling of a bore hole.

In another aspect, the described configuration and geometry of the hard insert 30, and in particular of the first and second webbed notches 52, 54, increases the strength and useful life of the hard insert 30 by reducing the axial forces applied to the center of the hard insert 30 in comparison to known insert designs.

Whereas particular embodiments of this invention have been described above for purposes of illustration, it will be evident to those skilled in the art that numerous variations of the details of the present invention may be made without departing from the invention as defined in the appended claims.

What is claimed is:

1. A hard insert for use with a roof drill bit, the hard insert comprising:

a first side and a second side opposing and generally parallel to the first side, the first and second sides extending in a longitudinal dimension of the hard insert, and further including opposing first and second ends that each extend between the first and second sides;

a top upper surface having a first inclined upper surface adjacent the first end and a second inclined upper surface adjacent the second end that are both positioned between the first and second sides, wherein the first inclined upper surface has an inner end spaced apart from the first end and the second inclined upper surface has an inner end spaced apart from the second end a first webbed notch and a second webbed notch structured and arranged on the top upper surface of the hard insert for removing drilling debris from the top upper surface of the hard insert during a drilling operation a cutting surface having a first cutting surface extending to the first end and being adjacent to the first inclined upper surface, a second cutting surface extending to the second end and being adjacent to the second inclined upper surface and a concave central cutting surface extending between the first webbed notch and the second webbed notch; and wherein the first webbed notch extends between the inner end of the first inclined upper surface and the second cutting surface and the second webbed notch extends between the inner end of the second inclined upper surface and the first cutting surface.

2. The hard insert of claim 1, wherein the first webbed notch is positioned at a generally central portion of the top upper surface of the hard insert.

3. The hard insert of claim 2, wherein the second webbed notch is positioned at the generally central portion of the top upper surface of the hard insert generally adjacent the first webbed notch.

4. The hard insert of claim 1, wherein the cutting surface extends from the first end to the second end.

5. The hard insert of claim 4, wherein the cutting surface is continuous from the first end to the second end.

6. The hard insert of claim 4, wherein the central cutting surface extends from the first cutting surface to the second cutting surface.

7. The hard insert of claim 6, wherein at least a portion of the central cutting surface separates the first webbed notch and the second webbed notch.

8. The hard insert of claim 1, wherein the first webbed notch is generally concave.

9. The hard insert of claim 1, wherein the second webbed notch is generally concave.

10. A roof drill bit, comprising:

an elongate roof drill bit body having a forward end and a rearward end, the roof drill bit body containing a slot at the forward end; and a hard insert received within the slot of the roof drill bit body, the hard insert comprising:

a first side and a second side opposing and generally parallel to the first side, the first and second sides extending in a longitudinal dimension of the hard insert, and further including opposing first and second ends that each extend between the first and second sides;

a top upper surface having a first inclined upper surface adjacent the first end and a second inclined upper surface adjacent the second end that are both positioned between the first and second sides, wherein the first inclined upper surface has an inner end spaced apart from the first end and the second inclined upper surface has an inner end spaced apart from the second end a first webbed notch and a second webbed notch structured and arranged on the top upper surface of the hard insert for removing drilling debris from the top upper surface of the hard insert during a drilling operation a cutting surface having a first cutting surface extending to the first end and being adjacent to the first inclined upper surface, a second cutting surface extending to the second end and being adjacent to the second inclined upper surface and a concave central cutting surface extending between the first webbed notch and the second webbed notch; and wherein the first webbed notch extends between the inner end of the first inclined upper surface and the second cutting surface and the second webbed notch extends between the inner end of the second inclined upper surface and the first cutting surface.

11. The roof drill bit of claim 10, wherein the slot includes an arched surface portion for receiving an arcuate surface portion formed in the bottom surface of the hard insert.

* * * * *